US009410560B2

(12) United States Patent
Coombs et al.

(10) Patent No.: US 9,410,560 B2
(45) Date of Patent: Aug. 9, 2016

(54) CONTROL VALVE ASSEMBLY

(75) Inventors: Jason R. Coombs, Lisbon, ND (US); Joseph A. St. Aubin, Wahpeton, ND (US); Jonathan J. Lacher, Fargo, ND (US); Rodney Koch, Mooreton, ND (US)

(73) Assignee: Clark Equipment Company, West Fargo, ND (US)

( * ) Notice: Subject to any disclaimer, the term of this patent is extended or adjusted under 35 U.S.C. 154(b) by 974 days.

(21) Appl. No.: 13/486,744

(22) Filed: Jun. 1, 2012

(65) Prior Publication Data

US 2013/0318958 A1 Dec. 5, 2013

(51) Int. Cl.
*F15B 11/16* (2006.01)

(52) U.S. Cl.
CPC ..... *F15B 11/16* (2013.01); *F15B 2211/3122* (2013.01); *F15B 2211/3133* (2013.01); *F15B 2211/31588* (2013.01); *F15B 2211/88* (2013.01); *Y10T 137/87177* (2015.04); *Y10T 137/87185* (2015.04)

(58) Field of Classification Search
CPC ..... F15B 11/16; F15B 11/20; F15B 11/02; F15B 2211/3116; F15B 2211/31588; F15B 2211/88; F15B 2211/3122; F15B 2211/3133; Y10T 137/87169; Y10T 137/87185; Y10T 137/87177
USPC ..... 91/189 A, 526; 60/424, 420, 422, 459, 60/468
See application file for complete search history.

(56) References Cited

U.S. PATENT DOCUMENTS 3,249,289 A * 5/1966 Maglott ..... 417/397
3,303,753 A 2/1967 McCay, Jr.

(Continued)

FOREIGN PATENT DOCUMENTS

CN 1676785 A 10/2005
CN 1970901 A 5/2007

(Continued)

OTHER PUBLICATIONS

Search Report and Written Opinion dated May 17, 2013 for International Application No. PCT/US2012/069508, filed Dec. 13, 2012, 10 pages.

(Continued)

*Primary Examiner* — Nathaniel Wiehe
*Assistant Examiner* — Logan Kraft
(74) *Attorney, Agent, or Firm* — John D. Veldhuis-Kroeze; Westman, Champlin & Koehler, P.A.

(57) ABSTRACT

A power machine and a power conversion system for a power machine are disclosed. In an exemplary embodiment, the power conversion system includes a pump configured to provide a source of pressurized hydraulic fluid and a control valve assembly to receive the hydraulic fluid. The control valve assembly includes a first valve element configured to direct hydraulic fluid to an actuator when the first valve element is in first and second actuated positions. The control valve assembly also includes a second valve element downstream of the first spool. The first valve element is moveable between an unactuated position and the first and second actuated positions and is configured to direct hydraulic fluid received from the actuator through the second actuated position to the second valve element and to direct hydraulic fluid received from the actuator through the first actuated position to bypass the second valve element.

19 Claims, 7 Drawing Sheets

(56) References Cited

U.S. PATENT DOCUMENTS

| | | | | |
|---|---|---|---|---|
| 3,628,424 | A | 12/1971 | Fruehauf et al. | |
| 3,722,543 | A | 3/1973 | Tennis | |
| 3,744,518 | A | 7/1973 | Stacey | |
| 4,329,845 | A | 5/1982 | Parquet et al. | |
| 4,408,518 | A | 10/1983 | Diel et al. | |
| 4,709,618 | A | 12/1987 | Zongker | |
| 4,977,928 | A * | 12/1990 | Smith et al. | 137/596 |
| 5,413,452 | A | 5/1995 | Lech et al. | |
| 5,873,244 | A * | 2/1999 | Cobo et al. | 60/422 |
| 6,029,445 | A | 2/2000 | Lech | |
| 6,244,158 | B1 * | 6/2001 | Roche | 91/446 |
| 6,308,612 | B1 | 10/2001 | Emanie et al. | |
| 6,612,109 | B2 | 9/2003 | Mickelson | |
| 7,162,869 | B2 * | 1/2007 | Yoshino | 60/414 |
| 7,222,484 | B1 * | 5/2007 | Dornbach | 60/422 |
| 7,251,934 | B2 | 8/2007 | Lech et al. | |
| 2001/0015129 | A1 | 8/2001 | Altman et al. | |

FOREIGN PATENT DOCUMENTS

| | | | |
|---|---|---|---|
| EP | 0816577 | A1 | 1/1998 |
| EP | 1584822 | A2 | 10/2005 |
| JP | S5375695 | | 7/1978 |

OTHER PUBLICATIONS

Chinese Office Action and English Translation dated Jan. 14, 2016 for Chinese Application No. 2012800727693, 21 pages.

* cited by examiner

CONTROL VALVE ASSEMBLY

FIELD

Disclosed embodiments relate to power machines that employ a control valve assembly for controlling hydraulic fluid flow provided to various actuators that are operably coupled to the control valve assembly.

BACKGROUND

Some power machines including skid steer loaders, tracked loaders, steerable axle loaders, excavators, telehandlers, walk behind loaders, trenchers, and the like, employ engine powered hydraulic power conversion systems. In some power machines, the hydraulic power conversion systems utilize an open center series control valve assembly that receives pressurized fluid from a pump. This control valve assembly typically has multiple valve elements to port hydraulic fluid to different work functions on the power machine. For example, on a work machine with a lift cylinder that raises and lowers a lift arm, a tilt cylinder that controls a tilt position of an implement carrier and thus an attached implement with respect to the lift arm, and one or more implement work actuators, the control valve assembly may have three (although any number can be used) valve elements, often in the form of linear spools, to port hydraulic fluid to the different actuators on the power machine and/or implement. The term open center refers to a feature in a valve assembly such that when a valve element is in an unactuated position (such as the center position on a typical spool valve) or a partially actuated position (such as in a proportional spool valve), at least some hydraulic fluid is allowed to flow through the unactuated position to a downstream valve element.

The valve elements in an open center control valve assembly are arranged such that the first valve element that receives hydraulic fluid from a pump has priority over subsequent downstream valve elements. A traditional priority in a power machine such as a skid steer loader is that the hydraulic fluid is provided first to a lift valve element, which is used to selectively control the lift cylinder to raise and lower the lift arm. Subsequently hydraulic fluid is provided to the tilt valve element, which is used to control the tilt cylinder and then to the auxiliary or implement valve element and then out of the valve.

It is known that in certain open center hydraulic control valve assemblies, when downstream valve elements are actuated to provide fluid to a downstream actuator, back pressures can be raised to a point where functionality of upstream elements can be limited or compromised.

The discussion above is merely provided for general background information and is not intended to be used as an aid in determining the scope of the claimed subject matter.

SUMMARY

Disclosed embodiments include a power machine and a power conversion system for a power machine. In an exemplary embodiment, the power conversion system includes a pump configured to provide a source of pressurized hydraulic fluid. A control valve assembly is coupled to the pump to receive the hydraulic fluid. The control valve assembly includes a first valve element configured to direct pressurized hydraulic fluid to and receive pressurized hydraulic fluid from an actuator when the first valve element is in first and second actuated positions. The control valve assembly also includes a second valve element downstream of the first valve element. The first valve element is moveable between an unactuated position and the first and second actuated positions. The control valve assembly is configured to direct hydraulic fluid received from the actuator through the second actuated position to the second valve element and direct hydraulic fluid received from the actuator through the first actuated position to bypass the second valve element.

This Summary and the Abstract are provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

DETAILED DESCRIPTION

The concepts disclosed herein are not limited in their application to the details of construction and the arrangement of components set forth in the following description or illustrated in the following drawings. That is, the embodiments disclosed herein are illustrative in nature. The concepts illustrated in these embodiments are capable of being practiced or being carried out in various ways. The phraseology and terminology used herein is for the purpose of description and should not be regarded as limiting. Words such as "including," "comprising," and "having" and variations thereof as used herein are meant to encompass the items listed thereafter, equivalents thereof, as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

Figure 1:
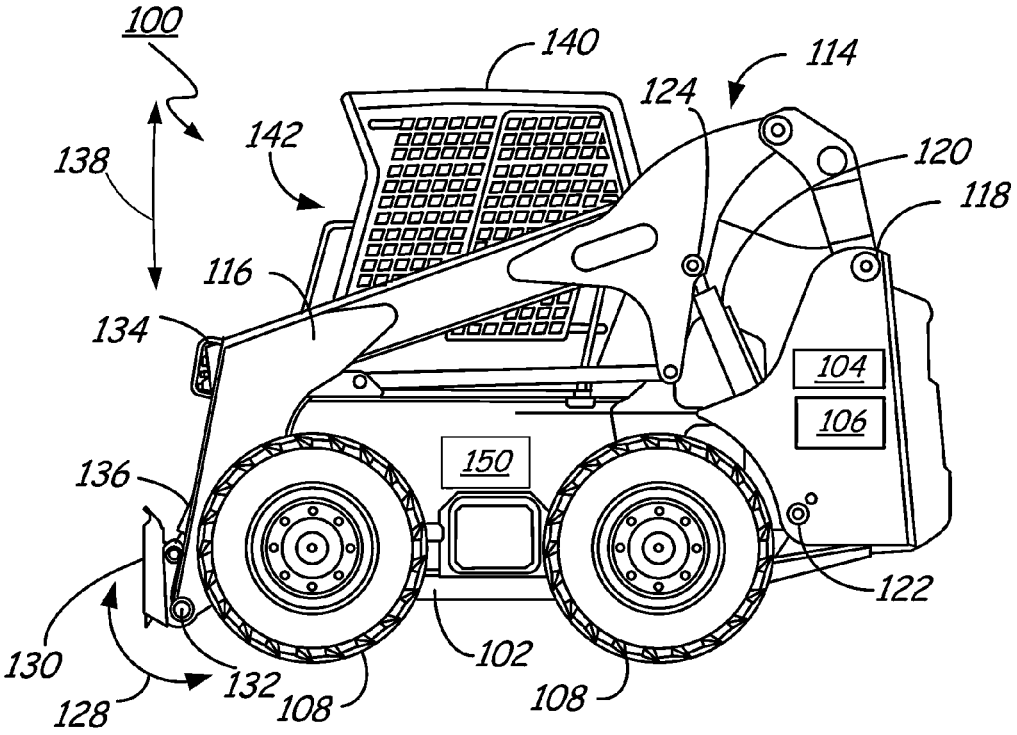
FIG. 1 is a side elevation view of a power machine having a power conversion system with a control valve assembly in accordance with exemplary embodiments.
Figure 2:
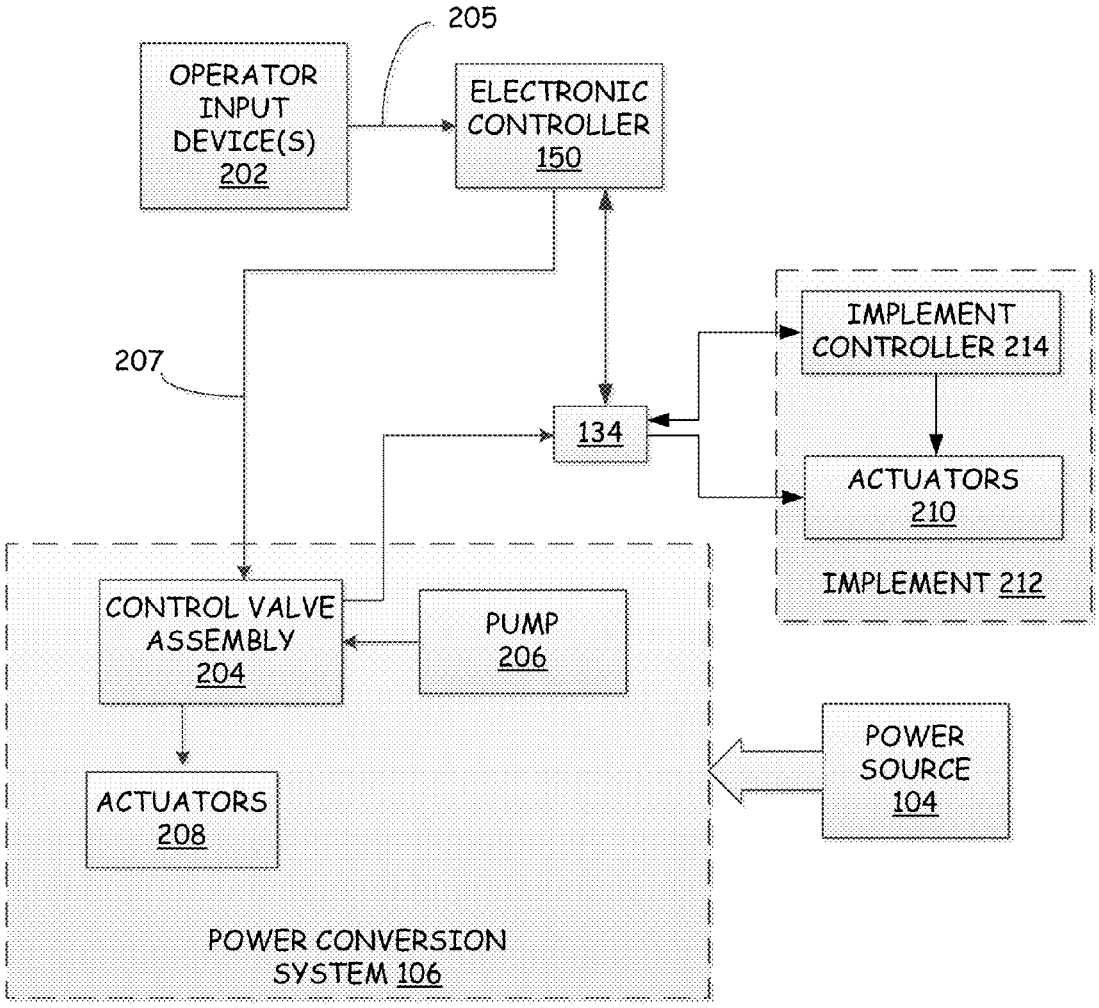
FIG. 2 is a block diagram illustrating components of the power machine and power conversion system of FIG. 1.

FIG. 1 is a side elevation view of a representative power machine 100 upon which the disclosed embodiments can be employed. FIG. 2 is a block diagram illustrating certain features and arrangements of the power machine. The power machine 100 illustrated in FIG. 1 is a skid loader, but other types of power machines such as tracked loaders, steerable wheeled loaders, including all-wheel steer loaders, excavators, telehandlers, walk behind loaders, trenchers, and utility vehicles, to name but a few examples, may employ the disclosed embodiments. The power machine 100 includes a supporting frame or main frame 102, which supports a power source 104, which in some embodiments is an internal combustion engine. A power conversion system 106 is operably coupled to the power source 104. Power conversion system 106 illustratively receives power from the power source 104 and operator inputs to convert the received power to power signals in a form that is provided to and utilized by functional components of the power machine. In some embodiments, such as with the power machine 100 in FIG. 1, the power conversion system 106 includes hydraulic components such as one or more hydraulic pumps and various actuators and valve components that are illustratively employed to receive and selectively provide power signals in the form of pressurized hydraulic fluid to some or all of the actuators used to control functional components of the power machine 100. For example, a control valve assembly 204 (shown in FIG. 2) can be used to selectively provide pressurized hydraulic fluid from a hydraulic pump 206 (shown in FIG. 2) to actuators 208 (shown in FIG. 2) such as hydraulic cylinders that are positioned on the power machine. In some embodiments, control valve assembly 204 also selectively provides pressurized hydraulic fluid to actuators 210 located on an implement 212 attached to the power machine. Other types of control systems are contemplated. For example, the power conversion system 106 can include electric generators or the like to generate electrical control signals to power electric actuators. For the sake of simplicity, the actuators discussed in the disclosed embodiments herein are referred to as hydraulic or electrohydraulic actuators, but other types of actuators can be employed in some embodiments.

Among the functional components that are capable of receiving power signals from the power conversion system 106 are tractive elements 108, illustratively shown as wheels, which are configured to rotatably engage a support surface to cause the power machine to travel. Other examples of power machines can have tracks or other tractive elements instead of wheels. In an example embodiment, a pair of hydraulic motors (not shown in FIG. 1), are provided to convert a hydraulic power signal into a rotational output. In power machines such as skid steer loaders, a single hydraulic motor can be operatively coupled to both of the wheels on one side of the power machine. Alternatively, a hydraulic motor can be provided for each tractive element in a machine. In a skid steer loader, steering is accomplished by providing unequal rotational outputs to the tractive element or elements on one side of the machine as opposed to the other side. In some power machines, steering is accomplished through other means, such as, for example, steerable axles.

The power machine 100 also includes a lift arm structure 114 that is capable of being raised and lowered with respect to the frame 102. The lift arm structure 114 illustratively includes a lift arm 116 that is pivotally attached to the frame 102 at attachment point 118. An actuator 120, which in some embodiments is a hydraulic cylinder configured to receive pressurized fluid from power conversion system 106, is pivotally attached to both the frame 102 and the lift arm 116 at attachment points 122 and 124, respectively. Actuator 120 is sometimes referred to as a lift cylinder, and is a representative example of one type of actuator 208 shown in FIG. 2. Extension and retraction of the actuator 120 causes the lift arm 116 to pivot about attachment point 118 and thereby be raised and lowered along a generally vertical path indicated approximately by arrow 138. The lift arm 116 is representative of the type of lift arm that may be attached to the power machine 100. The lift arm structure 114 shown in FIG. 1 includes a second lift arm and actuator disposed on an opposite side of the of the power machine 100, although neither is shown in FIG. 1. Other lift arm structures, with different geometries, components, and arrangements can be coupled to the power machine 100 or other power machines upon which the embodiments discussed herein can be practiced without departing from the scope of the present discussion.

An implement carrier 130 is pivotally attached to the lift arm 116 at attachment point 132. One or more actuators such as hydraulic cylinder 136 are pivotally attached to the implement carrier and the lift arm structure 114 to cause the implement carrier to rotate under power about an axis that extends through the attachment point 132 in an arc approximated by arrow 128 in response to operator input. In some embodiments, the one or more actuators pivotally attached to the implement carrier and the lift arm assembly are hydraulic cylinders capable of receiving pressurized hydraulic fluid from the power conversion system 106. In these embodiments, the one or more hydraulic cylinders 136, which are sometimes referred to as tilt cylinders, and are further representative examples of actuators 208 shown in FIG. 2. Although no implements are shown as being attached to the power machine 100 in FIG. 1, the implement carrier 130 is configured to accept and secure any one of a number of different implements (e.g., implement 212 shown in FIG. 2) to the power machine 100 as may be desired to accomplish a particular work task.

In some applications, a simple bucket can be attached to the implement carrier 130 to accomplish a variety of tasks. However, many other attachments that include various actuators such as cylinders and motors, to name two examples, can also be attached to the implement carrier 130 to accomplish a variety of tasks. A partial list of the types of implements that can be attached to the implement carrier 130 includes augers, planers, graders, combination buckets, wheel saws, and the like. These are only a few examples of the many different types of implements that can be attached to power machine 100. The power machine 100 provides a source, accessible at connection point 134, of power and control signals that can be coupled to an implement to control various functions on such an implement, in response to operator inputs. In one embodiment, connection point 134 includes hydraulic couplers that are connectable to the implement 212 for providing power signals in the form of pressurized fluid provided by the power conversion system 106 for use by an implement that is operably coupled to the power machine 100. Alternatively or in addition, connection point 134 includes electrical connectors that can provide power signals and control signals to an implement to control and enable actuators of the type described above to control operation of functional components on an implement. Actuation devices 210 located on an implement are controllable using control valve assembly 204 of power system 106.

Power machine 100 also illustratively includes a cab 140 that is supported by the frame 102 and defines, at least in part, an operator compartment 142. Operator compartment 142 typically includes an operator seat (not shown in FIG. 1) and operator input devices 202 (shown schematically in FIG. 2) and display devices accessible and viewable from a sitting position in the seat. When an operator is seated properly within the operator compartment 142, the operator can manipulate operator input devices 202 to control such functions as driving the power machine 100, raising and lowering the lift arm structure 114, rotating the implement carrier 130 about the lift arm structure 114 and make power and control signals available to implement 212 via the sources available at connection point 134.

In some embodiments, an electronic controller 150 (shown in FIGS. 1 and 2) is configured to receive input signals from at least some of the operator input devices 202 and provide control signals to the power conversion system 106 and to implements via connection point 134. It should be appreciated that electronic controller 150 can be a single electronic control device with instructions stored in a memory device and a processor that reads and executes the instructions to receive input signals and provide output signals all contained within a single enclosure. Alternatively, the electronic controller 150 can be implemented as a plurality of electronic devices coupled on a network. The disclosed embodiments are not limited to any single implementation of an electronic control device or devices. The electronic device or devices such as electronic controller 150 are programmed and configured by the stored instructions to function and operate as described.

Referring now more particularly to FIG. 2, further features of power machine 100 are shown in block diagram form in accordance with exemplary embodiments. As shown, the one or more operator input devices 202 are operatively coupled to electronic controller 150 via a network 205 or other hard wired or wireless connection. The operator input devices 202 are manipulable by an operator to provide control signals to the electronic controller 150 via network 205 to communicate control intentions of the operator. The operator input devices 202 are to provide control signals for controlling some or all of the functions on the machine such as the speed and direction of travel, raising and lowering the lift arm structure 114, rotating the implement carrier 130 relative to the lift arm structure, and providing power and control signals to an implement to name a few examples. Operator input devices 202 can take the form of joystick controllers, levers, foot pedals, switches, actuable devices on a hand grip, pressure sensitive electronic display panels, and the like.

In response to control signals generated by operator input devices 202, electronic controller 150 controls operation of control valve assembly 204 and actuators 208. In addition, electronic controller 150 can control actuators 210 on implement 212 or alternatively provide signals to an implement controller 214 that can, in turn, directly control one or more actuators 210 or provide control signals back to the electronic controller 150 to signal that control valve assembly 204 be actuated to provide hydraulic fluid to one or more of the actuators 210. Control of actuators 208 and 210 is, in at least some respects, performed using electrical signals on control lines or network 207 to control spool valves of control valve assembly 204 to selectively direct the flow of hydraulic fluid from pump 206 to those actuators. Flow of hydraulic fluid to actuators 210 on implement 212 is through hydraulic lines connected to the implement at connection point 134. Disclosed embodiments are described with reference to control of a control valve assembly 204 for selectively providing pressurized hydraulic fluid to actuators 208 on power machine 100, which can include lift cylinders 120 and tilt cylinders 136, and actuators 210 on implement 212 attached to implement carrier 130.

Figure 3:
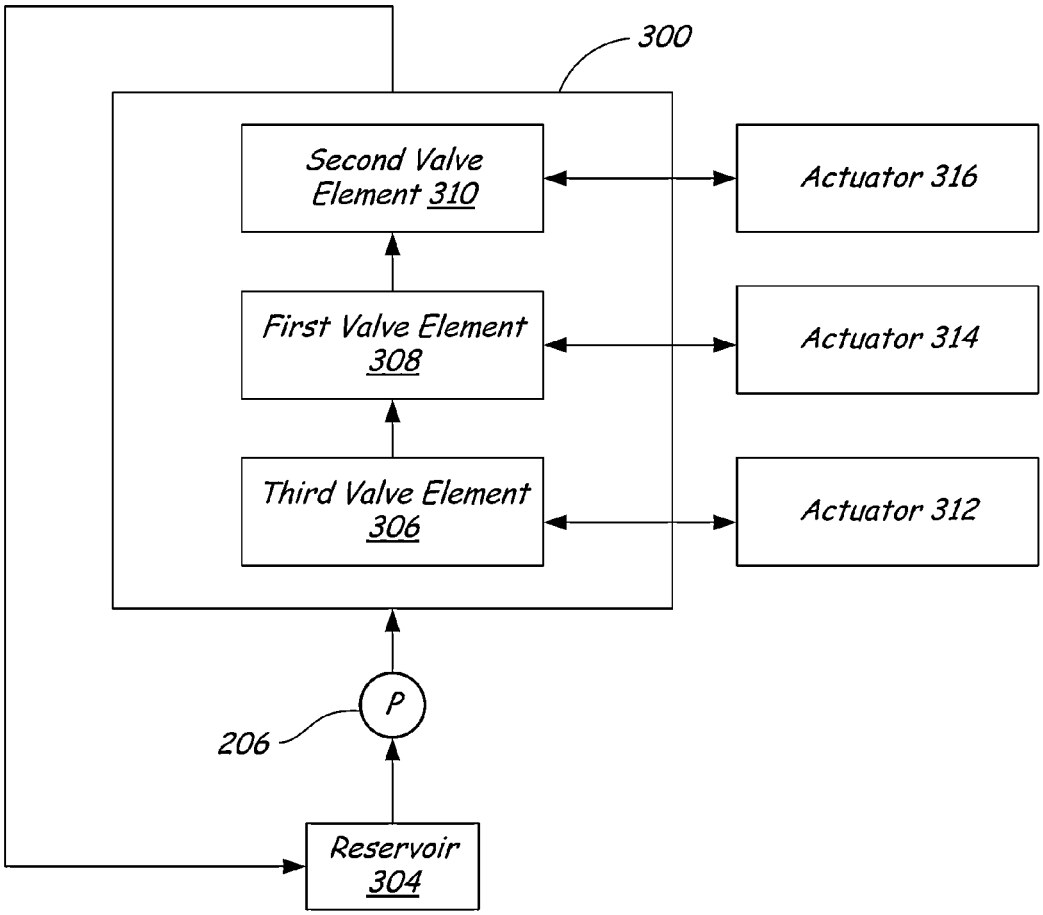
FIG. 3 is a block diagram illustrating a power conversion system according to one illustrative embodiment.

FIG. 3 illustrates a simple block diagram of one embodiment of a series control valve assembly 300 of the type that might be employed as control valve assembly 204 in the power machine 100 discussed above. Embodiments discussed in more detail below show and describe an open center series control valve assembly, but some of the concepts discussed herein can be applied to other types of control valves and need not be limited to an open center series control valve. Generally, the series control valve assembly 300 receives pressurized hydraulic fluid from pump 206, which draws fluid from a reservoir 304, which may or may not be pressurized. The series control valve assembly 300 includes a plurality of valve elements 306, 308, and 310 in a priority arrangement, i.e. valve element 306 receives pressurized fluid from the pump 206 first, and then fluid is provided next to valve element 308, and then to valve element 310. While three valve elements are shown, in alternative embodiments, an series control valve assembly can include a different number of valve elements. As shown, each of the valve elements 306, 308, and 310 is connected to and controls an actuator 312, 314, and 316 in a corresponding circuit. For the purposes of discussing the embodiments below, valve element 308 will be referred to as a first valve element, valve element 310 will be referred to as a second valve element, and valve element 306 will be referred to as a third valve element. As shown, the third valve element 306 has priority over both the first and second valve elements 308 and 310. First valve element 308 likewise has priority over the second valve element 310. After the pressurized fluid has passed through the control valve assembly 300, it is returned from the control valve assembly 300 to the reservoir 304. How oil passes through the control valve assembly 300 will be discussed in more detail below.

Referring now to FIGS. 4-7, series control valve assembly 300 is shown in more detail. Series control valve assembly 300 includes features that allow an upstream circuit that controls a machine function, such as the tilt function, to be controlled in either direction regardless of whether a high load exists on a downstream circuit, such as the implement circuit, that might otherwise prevent the upstream function from being actuated. The series control valve assembly 300 is described below with respect to the control of specific functions of a power machine, but it should be appreciated that concepts discussed below need not be incorporated only on the functions with which they are shown. More particularly, a bypass feature described below associated with a valve element that controls a tilt function can be incorporated on any spool or other applicable valve element to realize the advantages provided by such a feature. Series control valve assembly 300 is illustratively a spool valve assembly with three spools (although any number can be used). As illustrated, the third valve element 306 selectively provides hydraulic fluid to one or more lift arm actuators 312, the first valve element 308 selectively provides hydraulic fluid to one or more tilt actuators 314 and the second valve element 310 selectively provides hydraulic fluid to an auxiliary hydraulic port 316. Although other types of actuators may be employed, in the illustrated embodiment, the lift arm actuators 312 and tilt actuators 314 are hydraulic cylinders and will be described as such. In some embodiments, at least the first valve element 310 is a proportional spool that allows for metered flow as the spool moves from an unactuated position to a fully actuated position. By metering flow, partial actuation of a spool valve, in response to an operator input, for example, allows the operator to advantageously control the rate at which an actuator controlled by a proportional spool is operated. Thus, the rate at which a lift arm is raised or lowered or an implement carrier is rotated can be controlled. Any of the other valve elements in the series control valve assembly 300 can also be proportional spools.

In this example, third valve element 306 is a four-position lift spool, with position 322 being a float position in which each of a base end 330 and a rod end 332 of the one or more lift cylinders 312 ported to the reservoir 304 so that the lift arm is allowed to float while the power machine is traveling over terrain. Position 324 of the third valve element 306 is a commanded lowering position in which hydraulic fluid is ported to the rod ends 332 of the lift arm actuators 312 to lower the lift arm. Position 326 is a centered or unactuated position in which no command is provided to the lift cylinders 312, which causes the lift cylinders to remain in their current position. Position 328 is a raising position in which hydraulic fluid is ported to the base end 330 of actuator 312 to raise the lift arm.

The first valve element 308 is illustratively a three-position tilt spool. A first position 342 is illustratively a roll back position in which hydraulic fluid is ported to the rod ends 352 of tilt actuators 314 to cause the implement carrier 130 and any attached implement to pivot, or roll back, toward the lift arm structure 114. Position 344 is an centered or unactuated position in which no command is provided to the tilt cylinders 314, which causes the lift cylinders to remain in their current position. Position 346 being a roll out position in which hydraulic fluid is ported to base end 354 of actuator 314, which causes the implement carrier and any attached implement to pivot, or roll out, away from the lift arm structure 114. The second valve element 310 is also a three-position spool, with position 362 being a first actuated position configured to providing hydraulic fluid to a first line of the auxiliary port 134, position 364 being an unactuated centered position, and position 366 being a second actuated position for providing hydraulic fluid to a second line of auxiliary port 134. Check valves 311, 331 and 361 precede inlets to third, second, and third valve elements 306, 308 and 310, respectively, to prevent the flow of hydraulic fluid back through the spools when each of the spools is being actuated.

Figure 4:
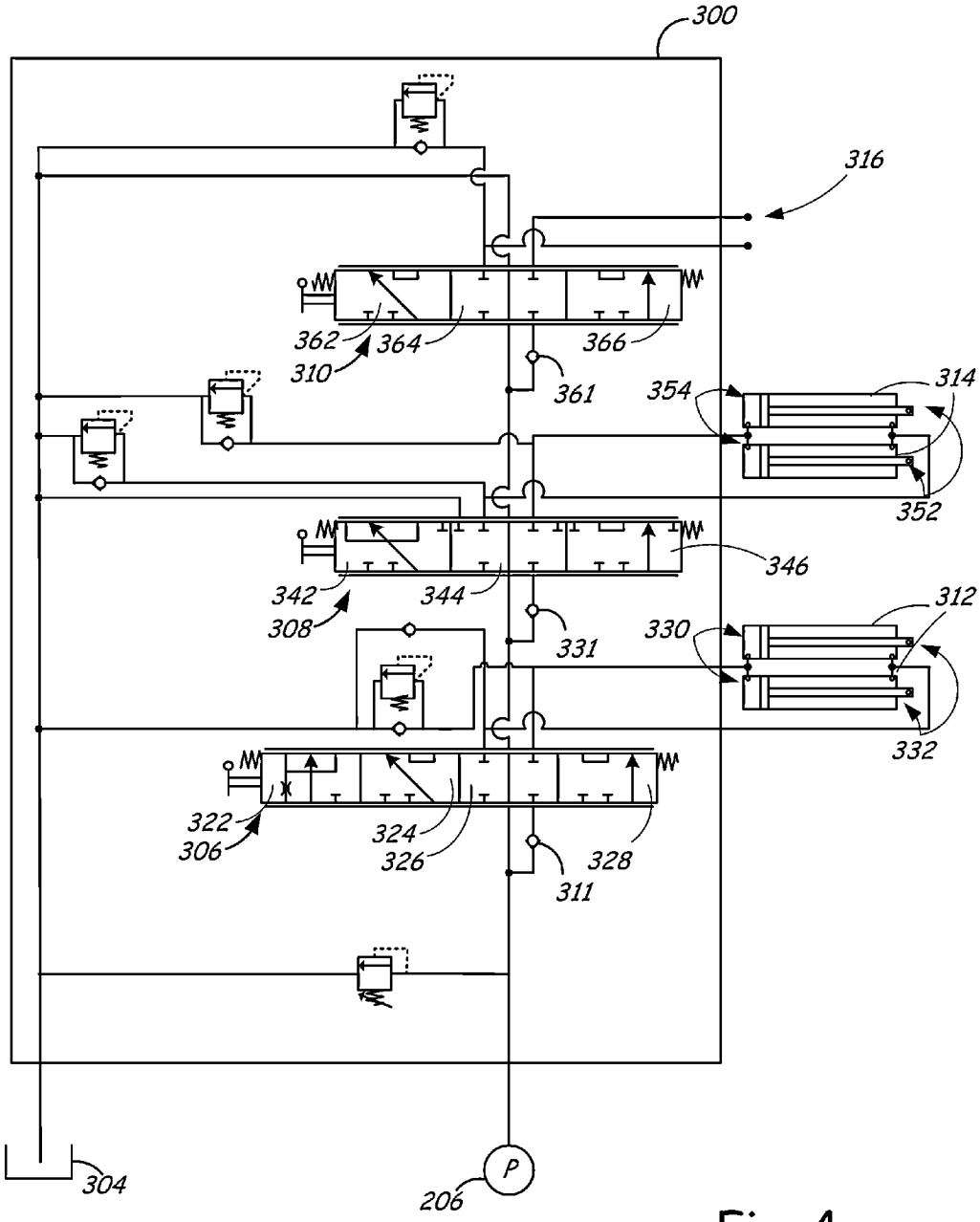
FIGS. 4-7 are hydraulic circuit diagrams illustrating an exemplary embodiment of a control valve assembly of FIG. 3 configured to implement disclosed embodiments and concepts.
Figure 5:
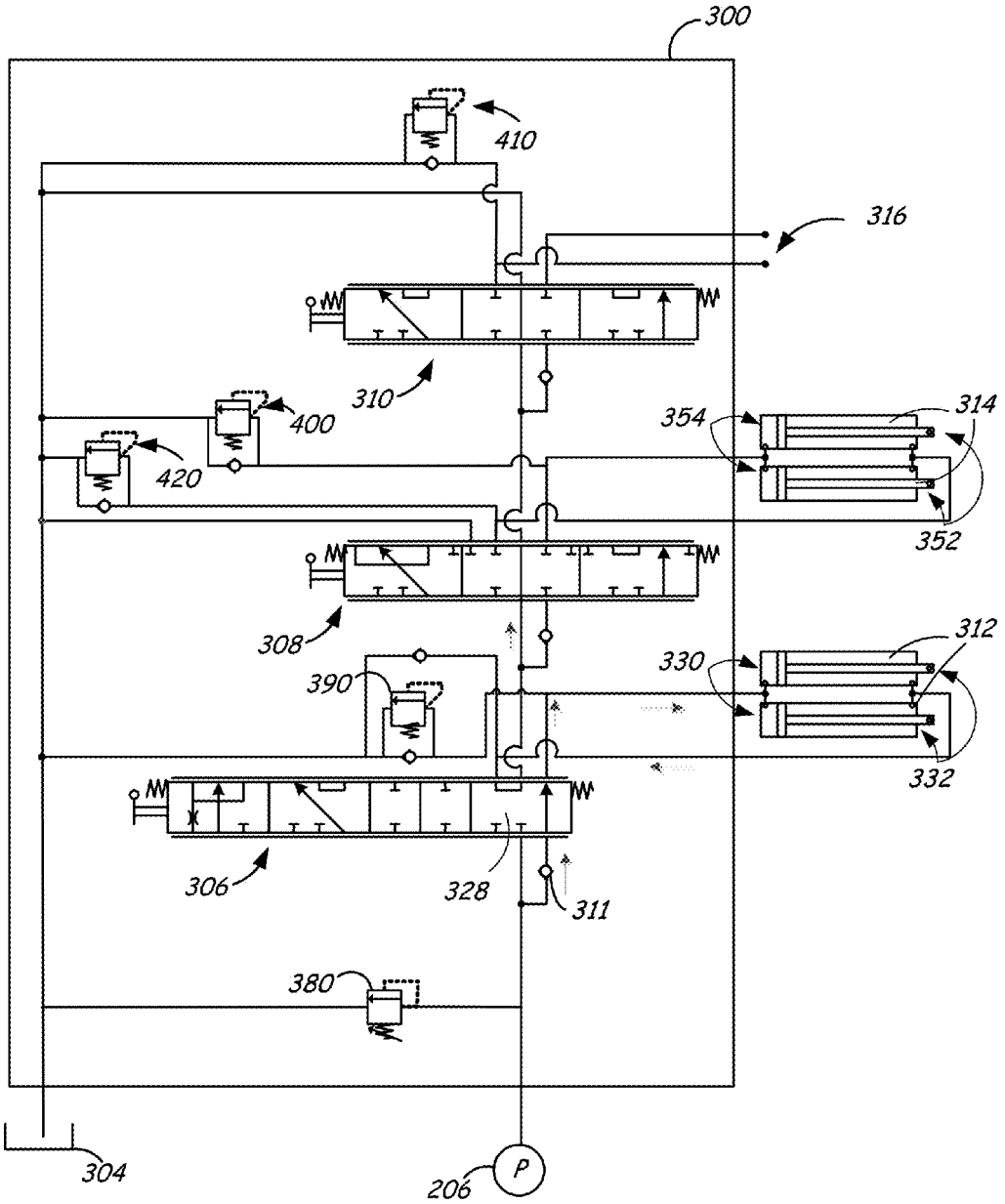
Figure 6:
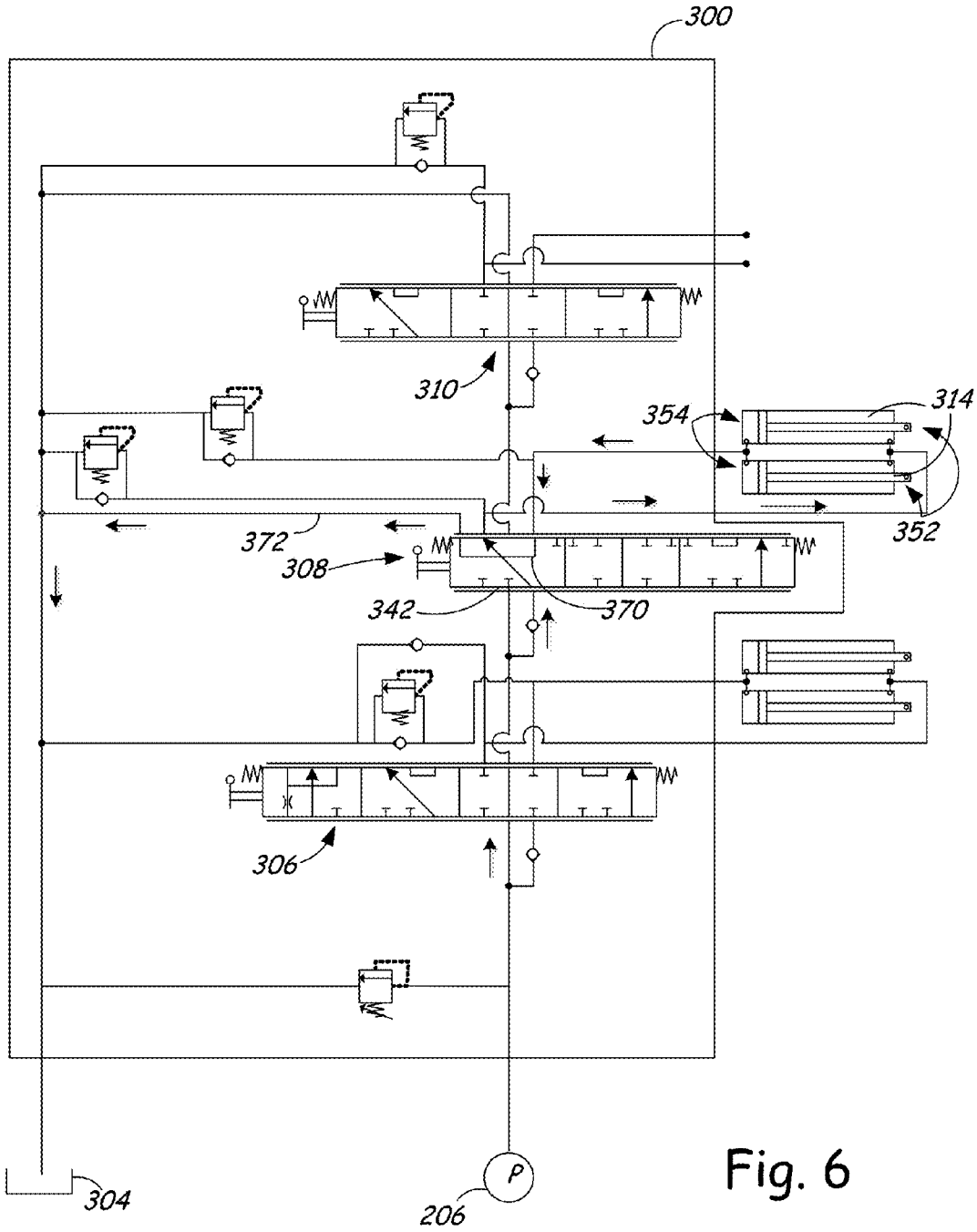
Figure 7:
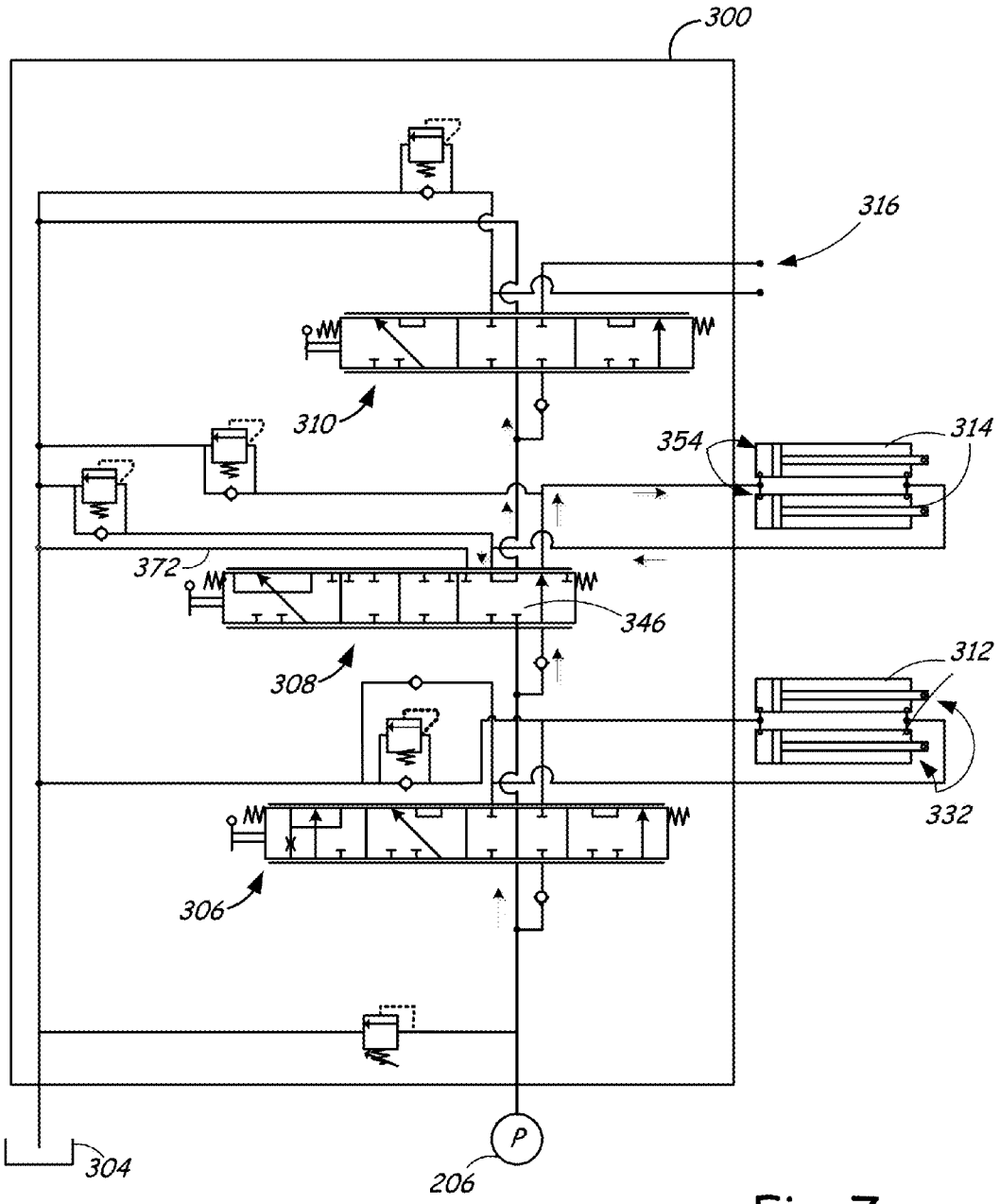

FIG. 4 illustrates each of the first 308, second 310, and third 306 valve elements in a centered or unactuated position. Hydraulic fluid is allowed to flow through each of the first, second, and third valve elements and back to reservoir 304. Referring now for the moment more specifically to FIG. 5, shown is control valve assembly 300 with lift spool 306 shifted to the raising position 328 to provide hydraulic fluid to the lift arm actuators 312 to raise the lift arm. In this position, hydraulic fluid from pump 206 passes through check valve 311 and into base end 330 of actuators 312, thus extending the actuator. The fluid path is illustrated with arrows in FIG. 5. As discussed above, at least the first element is a proportional spool. In an open center valve assembly, shifting the spools in either direction toward an actuated position may allow some fluid to continue to flow through the unactuated position toward downstream circuits unless and until the spool is fully shifted to the actuated position. FIG. 5, as well as FIGS. 6 and 7 illustrate the spools being shifted into a fully actuated position and arrows showing fluid flow do not indicate that any fluid flow is provided downstream via the unactuated positions, even though when the spools are not fully actuated, some fluid flow can be provided through the unactuated positions downstream. Hydraulic fluid forced from rod end 332 of actuator 312 is routed back through third valve element 306 and directed toward first valve element 308. This fluid path is also illustrated with arrows. When the lift arm actuators 312 are fully extended, porting fluid to the base end 330 of the cylinder will not force any more fluid out of the lift cylinders and into the downstream circuit. Furthermore, continuing to provide fluid to the base end of the lift cylinders could result in an extremely high pressure buildup on the base end. A relief valve 380 coupling the outlet of the relief valve to reservoir relieves high pressure port fluid away from the base end of the lift cylinder in this instance out of the control valve assembly 300 and eventually to the inlet of the reservoir 304.

In exemplary embodiments, each of valve elements 306, 308 and 310 of control valve assembly 300 has a port relief/anti-cavitation valve for relieving pressures across the corresponding actuator when the spool is in a centered position and/or the corresponding actuator is subject to cavitation. As such, relief valve 390 is shown coupled between base ends 330 of lift actuators 312 and reservoir 304. Relief valve 400 is shown coupled between base ends 354 of tilt actuators 314 and reservoir 304. Relief valve 420 is shown coupled between rod ends 352 of tilt actuators 314 and reservoir 304. Finally, relief valve 410 is shown coupled between a first auxiliary port and reservoir 304.

As mentioned, relief valve 380 acts to relieve pressure in the system when an actuator is deadheaded by dumping hydraulic fluid to reservoir 304 when a relief pressure of the valve 380 is reached or exceeded. In conventional designs, the use of downstream functions is severely compromised or effectively eliminated when fluid is run over the relief valve 380. Also, under conventional designs, when downstream pressures are high (such as near relief), functionality of upstream circuits are limited or compromised. Due to cylinder differential areas in upstream circuits, upstream circuits can be activated in one direction with high downstream pressure. That is, the lower cylinder area end (i.e. the rod end) can be relieved to reservoir over port relief valves so that a cylinder can be extended. However, it is not the case that an upstream cylinder can be retracted in such a situation in conventional designs. In fact, in many conventional open center valve configurations, the pressure conditions present when a downstream circuit is at high or even at relief pressure is that any attempt to retract an upstream cylinder will result in no retraction or even slight extension. In certain implement operating conditions, the ability to retract the tilt cylinder 314 (i.e., roll back the implement carrier) is desirable. While this is not possible under some conventional control valve designs, disclosed embodiments include features which allow the tilt cylinder to be retracted under a broader range of conditions.

Features of control valve assembly 300 that overcome the above-described limitations of some conventional control valve designs are now discussed with reference to FIGS. 6 and 7. FIG. 6 illustrates first valve element 308 in the form of a tilt spool moved to the second actuated position 342 in which hydraulic fluid is ported to the rod end 352 of actuator 314 through a path illustrated with arrows, to roll back the implement carrier 130 and any attached implement 212. FIG. 7 illustrates first valve element 308 in a first actuated position 346 in which hydraulic fluid is ported to base end 354 of actuator 314 to roll out the implement carrier and any attached implement.

As compared to conventional designs, the tilt circuit is modified such that when the first valve element 308 is shifted to the second actuated position 342 as shown in FIG. 6, the base ends 354 of the tilt cylinders 314 are ported (drained) to reservoir 304 through a fluid path 370 within the first valve element 308 and a drain line 372, as opposed to being connected to the inlet of the second valve element 310 as would be conventionally done. This fluid path 370 and drain line 372 can be considered to be parallel with the downstream function, from a perspective of the inlet to first valve element 308, in that both the second valve element 310 and the drain line 372 are connected to the outlet side of the first valve element 308. The drain line 372 is not actually in parallel with the downstream function from a perspective of the outlet of first valve element 308, though, as they do not share a common node at the outlet side of the first valve element 308. Rather, the drain line 372 is an alternative path such that the implement circuit is bypassed with no hydraulic fluid being provided to the inlet of the second valve element 310 via the second actuated position 342, although if the spool is not fully actuated into the second actuated position 342, some fluid may be provided to the inlet of the second valve element 310 via the unactuated position of the first valve element 308. When the first valve element 308 is in the first actuated position 346 to port hydraulic fluid to the base ends 354 of the tilt cylinders 314 so as to extend the cylinder, hydraulic fluid is provided to the inlet of the second valve element 310 and not to the drain 372 as shown in FIG. 7. This arrangement allows the first work function, in this embodiment, the tilt function, to be controlled in either direction whether or not a high load exists on the downstream circuit, in this embodiment, the implement circuit. This also allows the implement circuit to be controlled, except when the tilt cylinder is being retracted at full spool stroke. This arrangement advantageously allows for control of the actuator coupled to the first valve element in either direction, regardless of whether there is a high pressure load downstream of the first valve element. In addition, in embodiments where proportional valves are employed, any actuator in communication with the second valve element can still be controlled if the first valve element is not in one of the fully actuated positions. In the embodiment described above, if a tilt cylinder is slowly retracted from a position when an implement is operating a cutting function, such as a planer, the implement is still actuated when the tilt cylinder is retracted.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims. For example, in various embodiments, different types of power machines can be configured to implement the control valve assembly and power conversion systems and methods. Further, while particular control valve assembly configurations and work functions are illustrated, other valve configurations and types of work functions can also be used. Other examples of modifications of the disclosed concepts are also possible, without departing from the scope of the disclosed concepts.

What is claimed is:

1. A power conversion system for a power machine, comprising:

a pump configured to provide a source of pressurized hydraulic fluid;

a control valve assembly coupled to the pump to receive the pressurized hydraulic fluid from the pump, the control valve assembly including:

a first valve element having an unactuated position and first and second actuated positions, the first valve element configured to direct pressurized hydraulic fluid to and receive pressurized hydraulic fluid from an actuator when the first valve element is in the first and second actuated positions; and a second valve element downstream of and in series with the first valve element when the first valve element is in the unactuated position, the second valve element having first and second actuated positions; and wherein the first valve element is moveable between the unactuated position and the first and second actuated positions, and wherein the control valve assembly is configured to direct hydraulic fluid received from the actuator through the second actuated position to the second valve element, and direct hydraulic fluid received from the actuator through the first actuated position to bypass the second valve element.

2. The power conversion system of claim 1, wherein the first and second valve elements are spool valves.

3. The power conversion system of claim 1, wherein the actuator is a tilt cylinder, and wherein the second valve element is configured to control implement actuator functions.

4. The power conversion system of claim 3, wherein in the first actuated position, hydraulic fluid received from a base end of the tilt cylinder is directed to a reservoir through a fluid path in the first actuated position.

5. The power conversion system of claim 3, wherein the second actuated position of the first valve element is configured to direct pressurized hydraulic fluid to a base end of the tilt cylinder.

6. The power conversion system of claim 1, wherein the control valve assembly further comprises a third valve element upstream of the first valve element.

7. A power conversion system for a power machine, comprising:

a pump configured to provide a source of pressurized hydraulic fluid;

a work actuator for controlling a work function; and a control valve assembly in communication with the pump to receive the pressurized hydraulic fluid, including:

a first spool having an unactuated position and first and second actuated positions configured to direct pressurized hydraulic fluid to the work actuator and receive pressurized hydraulic fluid returned from the work actuator;

a second spool downstream of and in series with the first spool when the first spool is in the unactuated position, the second spool having first and second actuated positions; and wherein the first spool is configured to direct hydraulic fluid returned from the work actuator through the second actuated position to the second spool and direct hydraulic fluid returned from the work actuator through the first actuated position to bypass the second spool.

8. The power conversion system of claim 7, wherein the control valve assembly further comprises a third spool upstream of the first spool.

9. A power machine including the power conversion system of claim 7, wherein the work actuator is configured to selectively position an implement carrier on the power machine.

10. The power machine of claim 9, wherein the second spool is configured to provide a source of pressurized hydraulic fluid connectable to an implement coupled to the implement carrier.

11. The power machine of claim 9, wherein hydraulic fluid provided to the work actuator through the second actuated position of the first spool causes the implement carrier to roll out relative to the power machine.

12. The power machine of claim 9, wherein hydraulic fluid provided to the work actuator through the second actuated position of the first spool causes the implement carrier to roll back relative to the power machine.

13. The power conversion system of claim 7, wherein the control valve assembly is an open center control valve assembly.

14. The power conversion system of claim 7, wherein the first spool is a proportional spool having an unactuated position between the first actuated position and the second actuated position and wherein when the spool is moved from the unactuated position toward the first actuated position, hydraulic fluid is provided to the second spool via the unactuated position until the spool is fully moved to the first actuated position.

15. A power machine having a frame, a lift arm pivotally coupled to the frame, and an implement carrier pivotally coupled to the lift arm, and further comprising:

a power source;

an operator input device configured to provide control signals; and a power conversion system coupled to and receiving power from the power source, the power conversion system including:

a pump configured to provide a source of pressurized hydraulic fluid;

a work actuator; and an open center control valve assembly in fluid communication with the pump and including first and second spools, the first spool configured to direct pressurized hydraulic fluid and receive pressurized hydraulic fluid from the work actuator in response to the control signals via first and second actuated positions, the first spool being configured to direct hydraulic fluid received from the work actuator available to the second spool via the second actuated position and to direct hydraulic fluid received from the first work actuator via the first actuated position to bypass the second spool;

wherein the power machine further comprises at least one hydraulic line in communication with the second spool connectable to an external actuator and wherein the second spool is configured to direct pressurized hydraulic fluid to the at least one hydraulic line in response to the control signals.

16. The power machine of claim 15, wherein the first spool is a proportional spool having an unactuated position between the first actuated position and the second actuated position and wherein when the spool is moved from the unactuated position toward one of the first and second actuated positions, hydraulic fluid is provided to the second spool via the unactuated position until the spool is fully moved to one of the first and second actuated positions.

17. The power machine of claim 15, wherein hydraulic fluid received from the work actuator via the first actuated position is directed to a low pressure outlet.

18. The power machine of claim 15, wherein the work actuator is a hydraulic cylinder pivotally coupled to the lift arm and the implement carrier and actuable to rotate the implement carrier relative to the lift arm.

19. The power machine of claim 15, wherein the open center control valve assembly further includes a third spool upstream of the first spool.

* * * * *